US007386138B2

(12) United States Patent
Kajiwara et al.

(10) Patent No.: US 7,386,138 B2
(45) Date of Patent: Jun. 10, 2008

(54) MULTIFUNCTION SPEAKER

(75) Inventors: Hiroo Kajiwara, Yamanashi-ken (JP); Kazumi Miyamoto, Yamanshi-ken (JP)

(73) Assignee: Citizen Electronics Co., Ltd., Yamanashi-ken (JP)

( * ) Notice: Subject to any disclaimer, the term of this patent is extended or adjusted under 35 U.S.C. 154(b) by 633 days.

(21) Appl. No.: 11/057,198

(22) Filed: Feb. 15, 2005

(65) Prior Publication Data

US 2005/0180593 A1 Aug. 18, 2005

(30) Foreign Application Priority Data

Feb. 16, 2004 (JP) ..... 2004-039075
Apr. 28, 2004 (JP) ..... 2004-132292

(51) Int. Cl.
*H04R 25/00* (2006.01)

(52) U.S. Cl. ..... 381/189; 381/151

(58) Field of Classification Search ..... 381/150, 381/151, 182, 189, 394, 395, 396, 398, 400, 381/406, 409, 410, 412; 310/81; 335/222; 340/388.1, 388.3, 388.4, 391.1
See application file for complete search history.

(56) References Cited

U.S. PATENT DOCUMENTS 7,277,555 B2 * 10/2007 Klein et al. ..... 381/412
2002/0061115 A1 * 5/2002 Chung et al. ..... 381/398
2002/0164040 A1 * 11/2002 Yang ..... 381/150

* cited by examiner

*Primary Examiner*—Brian Ensey
(74) *Attorney, Agent, or Firm*—Dennison, Schultz & McDonald

(57) ABSTRACT

A multifunction speaker comprises a frame made of an insulation material and having a terminal supporting portion, a pair of supporting springs are partly embedded in the frame. A magnetic circuit is resiliently supported in the frame by the springs, a diaphragm is secured to the frame, a coil is secured to the diaphragm, an upper metal protector and a lower metal protector are set on the frame. The upper and lower protectors are secured to each other so as to shield the frame except the terminal supporting portion of the frame, a pair of terminals are provided on the terminal supporting portion, each of the terminals is connected to an end of the coil, and a ground terminal is provided on the terminal supporting portion and is connected to either of the upper and lower protectors.

11 Claims, 6 Drawing Sheets

MULTIFUNCTION SPEAKER

BACKGROUND OF THE INVENTION

The present invention relates to a multifunction speaker used in a mobile transmission instrument such as a portable telephone, PDA (Personal Digital Assistant) and video game device. The multifunction speaker is provided with a vibrating function device for informing a user when a calling signal is applied.

A conventional mobile transmission instrument such as a portable telephone and PDA is generally adapted to change the calling operation thereof from generating buzzer sounds and melodies to vibrating a case of the instrument without producing sounds for informing the user of a calling signal. In order to achieve that kind of operation, a small speaker for generating sounds and a vibrating device in which an eccentric weight is vibrated by the rotation of a small motor are provided separately in a mobile transmission instrument. However, incorporating both the speaker and the vibrating device in the instrument is disadvantageous in rendering the instrument compact and inexpensive. Thus, there has been provided a multifunction speaker capable of generating both the sounds and the vibration within a single device such as that described in FIG. 1 and paragraphs 0016 to 0019 of Japanese Patent Application Laid-Open 2001-225010.

FIG. 8 is a plan view of that kind of conventional multifunction speaker 101 mentioned above, FIG. 9 is a sectional view taken along a line IX-IX of FIG. 8, and FIG. 10 is a bottom view of the multifunction speaker 101.

Referring to FIGS. 8 and 9, the multifunction speaker 101 comprises a substantially cylindrical molded frame 102 having cylindrical portion 102*a*. A part of the periphery of the cylindrical portion 102*a* is extended to form a terminal supporting portion 102*b*. The cylindrical molded frame 102 has an upper stepped portion 102*c*. An upper first supporting spring plate 103 is mounted on a stepped portion 102*c* of the cylindrical portion 102*a* and a lower second spring plate 104 is attached on an underside 102*d* of the frame 102. Each of the spring plates 103 and 104 comprises an annular inner portion, annular outer portion, and a plurality of arcuate arms connecting the inner and outer portions.

On the lower second spring plate 104, there is mounted a pole piece 105 made of a magnetic material and having a center pole 105*a* and a flange 105*b*. An annular magnet 106 is securely mounted on the flange 105*b* and an annular top plate 107 made of a magnetic material is securely mounted on the annular magnet 106 thereby forming a magnetic circuit 112. The inner periphery of the spring plate 103 abuts on the outer edge of the top plate 107 thereby to support the top plate 107. Accordingly, the magnetic circuit 112 is resiliently supported in the frame 102 by the first and second spring plates 103 and 104.

A plastic diaphragm 108 is mounted on the upper stepped portion 102*c* of the frame 102 and held by a ring 110 having an L shape in section. A cylindrical coil 111 which is secured to a lower part of the diaphragm 108 is inserted in a magnetic gap G formed between the inner periphery of the top plate 107 and the outer periphery of the center pole 105*a*.

A positive terminal 113 and a negative terminal 114 each having a U-shaped section are inserted in respective slits formed in the terminal supporting portion 102*b* of the frame 102. Each of the positive and negative terminals 113 and 114 is bent after being inserted in the slit. Both ends of the positive and negative terminals 113 and 114 have an overlapped portion, respectively. Hence a pair of external terminals are formed. Ends 111*a* of the cylindrical coil 111 are connected to the terminals by solders. A resin 116 is applied to protect the solders 115.

The multifunction speaker 101 further has a disk shaped metallic first protector 117, the periphery of which is embedded in the ring 110. The first protector 117 has a plurality of sound emanating holes 117*a*. A disk shaped metallic second protector 118 is mounted on the lower portion of the frame 102 interposing the second spring plate 104 and an annular spacer 120. The second protector 118 has a plurality of vents 118*a* as shown in FIG. 10.

In operation, when a driving signal of audio frequency is applied to the cylindrical coil 111, the cylindrical coil 111 generates an exciting force which interferes with the magnetism of the magnet 106. Accordingly, the diaphragm 108 is vibrated due to the attraction in the magnetic circuit 112 to generate sounds. When the frequency of the applied signal is low, while no sound is generated from the diaphragm 108, since the magnetic circuit 112 is resiliently supported in the frame 102, the relative position of the coil 111 to the magnetic circuit 112 changes, so that the magnetic circuit 112 is vibrated. The vibration is transmitted to the frame 102 causing a case in which the multifunction speaker 101 is housed to resonate. As a result, when the multifunction speaker 101 is adopted in a small instrument such as a video game device and telephone, the user is able to feel the vibration at the fingertip or other parts of the body with which the case is in contact. Hence the production of both the sound and vibration becomes possible with only one speaker.

However, in the conventional multifunction speaker, since the side periphery of the frame is not covered by a protector, external electromagnetic waves and electric field have an influence on the operation of the magnetic circuit, causing electromagnetic noises which affect the performance of the speaker. Furthermore, in the case of a conventional multifunction speaker being used in a portable telephone for example, the caused electromagnetic noises also affect the external instrument, the portable telephone here.

SUMMARY OF THE INVENTION

An object of the present invention is to provide a multifunction speaker where the external electromagnetic waves and electric field waves are shut out so that the malignant influence of the waves is eliminated.

According to the present invention, there is provided a multifunction speaker comprising a frame made of an insulation material and having a cylindrical portion and a terminal supporting portion, at least one supporting spring secured to the frame, a magnetic circuit forming a magnetic gap and resiliently supported in the frame by the spring, a diaphragm secured to the frame at a peripheral edge of the diaphragm, a coil secured to a lower part of the diaphragm and inserted in the magnetic gap, an upper metal protector set on an upper portion of the frame, a lower metal protector set on a lower portion of the frame, the upper and lower protectors being fitted to each other so as to shield the frame except the terminal supporting portion.

Each of the upper and lower protectors has a peripheral portion, both peripheral portions have a cylindrical-protruding portion, respectively. The upper and lower metal protectors have an overlapping portion at the peripheral portions thereof so as to be electrically connected.

There is further provided a pair of terminals provided on the terminal-supporting portion, each of the terminals being connected to an end of the coil, and a ground terminal also provided on the terminal-supporting portion, and being connected to one of the upper and lower protectors.

The magnetic circuit is electrically connected to one of the protectors by the spring, and the terminal supporting portion is outwardly projected from the cylindrical portion of the frame. The ground terminal may be connected to one of the pair terminals instead of being connected to the metal protector. The supporting spring is partly embedded in the frame at the annular outer portion. There may be provided at least one supporting spring. If a plurality of springs are provided to resiliently support the magnetic circuit in a multifunction speaker, the vibrating motion can be more stabilized, compared to a case using one supporting spring.

The annular outer portion of the supporting spring may be partly embedded in the frame and in some part, penetrate the frame, and contacts one of the upper or lower protectors. The frame-penetrated outer portion of the supporting spring may have a bending portion which sets in a space formed by the outside wall of the cylindrical frame and one of the cylindrical-protruding portion of the protectors, and the annular outer portion of the supporting spring contacts electrically one of the cylindrical-protruding portion of the protectors.

At least one opening is formed in one of the cylindrical peripheral portions of the protectors, and at least one bent portion of the other cylindrical portion is engaged with the opening.

These and other objects and features of the present invention will become more apparent from the following detailed description with reference to the accompanying drawings.

DETAILED DESCRIPTION OF THE PREFERRED EMBODIMENT

Figure 1:
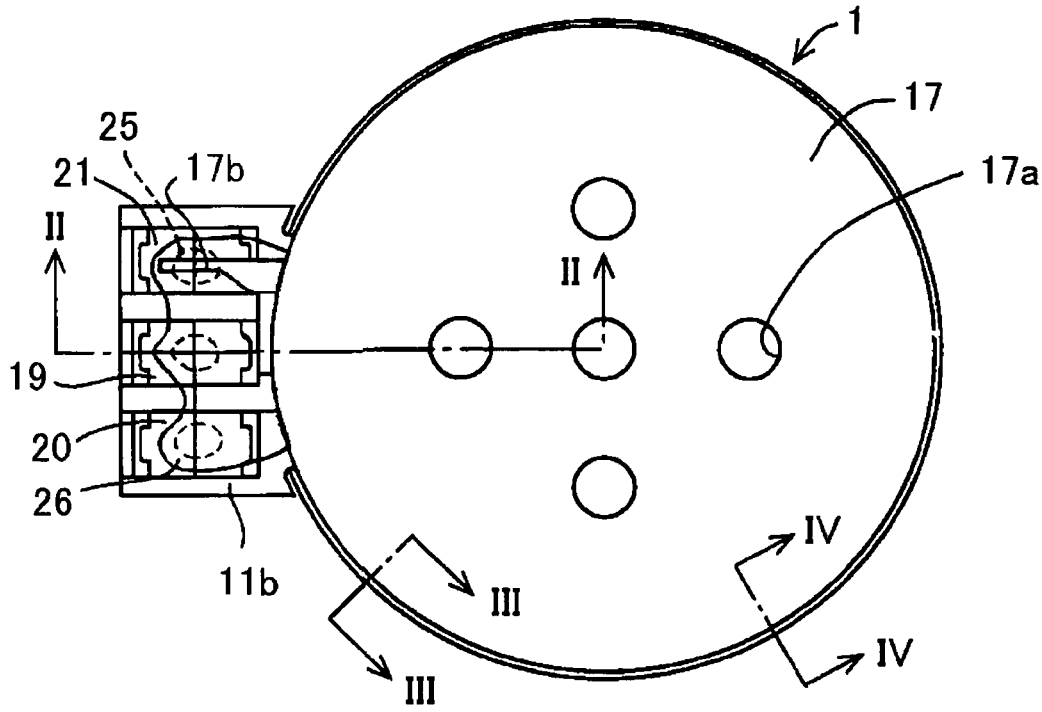
FIG. 1 is a plan view of a multifunction speaker according to the present invention.
Figure 4:
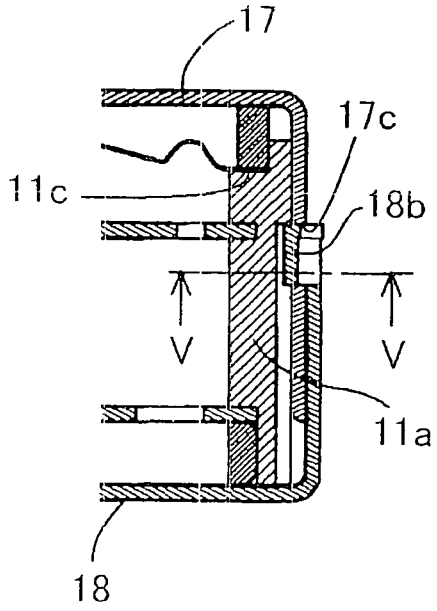
FIG. 4 is a sectional view taken along a line IV-IV of FIG. 1.
Figure 5:
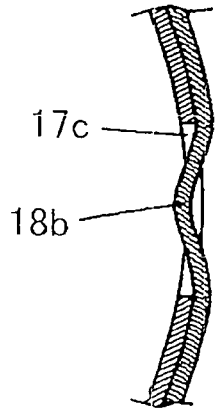
FIG. 5 is a sectional view taken along a line V-V of FIG. 4.

A first embodiment according to the present invention is described hereinafter. FIG. 1 is a plan view of a multifunction speaker as a first embodiment according to the present invention, FIG. 2 is a sectional view taken along a line II-II of FIG. 1, FIG. 3 is a sectional view taken along a line III-III of FIG. 1, FIG. 4 is a sectional view taken along a line IV-IV of FIG. 1, and FIG. 5 is a sectional view taken along a line V-V of FIG. 4.

Figure 2:
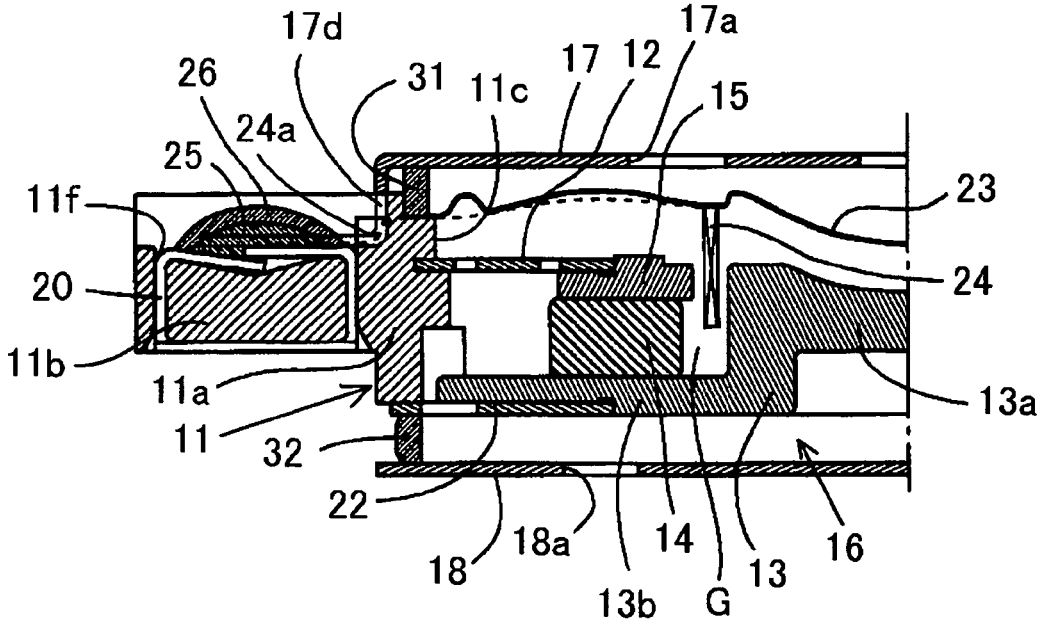
FIG. 2 is a sectional view taken along a line II-II of FIG. 1.
Figure 3:
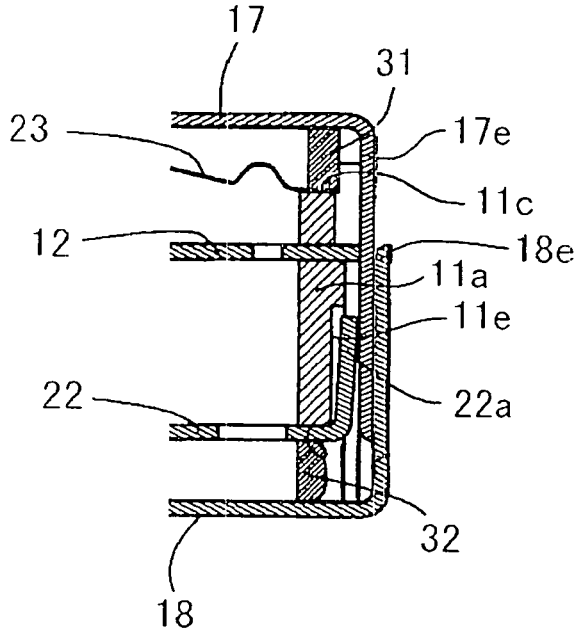
FIG. 3 is a sectional view taken along a line III-III of FIG. 1.

Referring to FIGS. 1 to 3, a multifunction speaker 1 according to the present invention has a substantially cylindrical molded frame 11 made of an insulation material such as plastic in which an integrated speaker and vibration mechanism is provided. The frame 11 has a cylindrical portion 11*a* and a terminal-supporting portion 11*b* outwardly projected from the cylindrical portion 11*a*.

The cylindrical portion 11*a* of the frame 11 has an upper stepped portion 11*c*. An upper first supporting spring 12 such as a spring plate is mounted on a stepped portion of the cylindrical portion 11*a* and a lower second spring 22 such as a spring plate is attached to an underside of the frame 11.

On the spring 22, there is mounted a pole piece 13 made of a magnetic material and having a center pole 13*a* and a flange 13*b*. An annular magnet 14 is securely mounted on the flange 13*b* and an annular top plate 15 made of a magnetic material is securely mounted on the magnet 14, thereby forming the magnetic circuit 16, which is resiliently supported by at least one spring. The inner periphery of the supporting spring 12 may abut on the outer edge of the top plate 15 thereby to support the top plate 15. Accordingly, the magnetic circuit 16 is resiliently supported in the frame 11 by the first and second springs 12 and 22 here.

A plastic diaphragm 23 is mounted on the upper stepped portion 11*c* of the frame 11 and held by an annular spacer 31. A cylindrical coil 24 which is securely attached on the underside of the diaphragm 23 is inserted in a magnetic gap G formed between the inner periphery of the top plate 15 and the outer periphery of the center pole 13*a*.

There is provided a cylindrical metal upper protector 17 having a plurality of sound emanating holes 17*a*, and a cylindrical metal lower protector 18 similar in shape to the upper protector 17 and having a plurality of vents 18*a*. Each of the upper and lower protectors has a peripheral portion, and both peripheral portions have a cylindrical-protruding portion, respectively. The upper and lower metal protectors have an overlapping portion at the peripheral portions thereof so as to be electrically connected. The cylindrical portion 11*a* of the frame 11 is mounted on the lower protector 18 interposing an annular spacer 32 and the annular lower supporting spring 22. The vertical position of the lower protector 18 is determined in accordance with the thickness of the spacer 32. The upper protector 17 is mounted on the cylindrical-protruding portion 18*e* interposing the annular spacer 31 and an edge of the diaphragm 23. The vertical position of the upper protector 17 is determined in accordance with the thickness of the spacer 31.

As shown in FIG. 3, the spring 22 partly embedded in the frame has a bending portion 22*a* which is extended out of the frame 11 and upwardly bent along a space 11*e* formed between a lower outer periphery of the cylindrical portion 11*a* of the frame 11 and the connected peripheral portions of the upper and lower protectors.

The upper protector 17 has a downwardly projected cylindrical peripheral portion 17*e* and the lower protector 18 has an upwardly projected cylindrical peripheral portion 18*e*. The peripheral portion 17*e* is inserted in the peripheral portion 18*e* thereby to shield the frame 11 except the terminal supporting portion 11*b*. The upper portion of the projection 22*a* of the spring 22 is pressed against the inner periphery of the peripheral portion 17*e* so that the spring 22 is electrically connected to the upper protector 17. The spring connected protector, of course, may be the lower protector, depending on the convenience of an embodiment.

Referring to FIGS. 4 and 5, in order to securely hold the upper protector 17 in the lower protector 18, the cylindrical-protruding portion 17*e* of the upper protector 17 is provided with a plurality of circumferentially elongated openings 17*c* which are arranged in a circumferential direction. In each of the openings 17*c*, an inwardly bent portion 18*b* of cylindrical-protruding portion 18*e* of the lower protector 18 is inserted and fixedly engaged with inside edges of the opening. Thus, the upper protector 17 and the lower protector 18 are electrically connected to each other.

The numbers of the circumferentially elongated openings and the inwardly bent portions may be selected, depending on the convenience of an embodiment.

Referring back to FIG. 2, a part of the cylindrical-protruding portion 17*e* of the lower portion of the upper protector 17 is cut out to form a recess 17*d* from which the terminal supporting portion 11*b* of the frame 11 is projected. As shown in FIG. 1, a positive terminal 19, negative terminal 20, and a ground terminal 21 each having a U-shaped section are inserted in respective slits 11*f* formed in the terminal supporting portion 11*b*. As shown in FIG. 2, each of the terminals 19 to 20 is bent after being inserted so that the ends thereof overlap with each other. The positive and negative terminals 19 and 20 are connected to ends 24*a* of the coil 24, and the ground terminal 21 is connected to a connecting lug 17*b* outwardly projecting from the upper protector 17 by solders 25 as shown in FIG. 1. The upper and lower protectors are connected at the peripheral portions thereof as mentioned above. Thus the upper and lower protectors 17 and 18 are electrically connected to the ground terminal 21 by the connecting lug 17*b*. The spring 22 resiliently supporting the magnetic circuit 16 is connected to either of the upper and the lower protectors at a bending portion 22*a* thereof, and the connecting lug 17 projecting from the upper protector is connected to the ground terminal 21 as mentioned above. Therefore, the magnetic circuit 16 is electrically connected to the ground terminal. The ground terminal 21 is to be electrically connected to an outside member such as a case of a portable telephone in which the speaker is mounted. Further, the negative terminal 20 may be connected to the ground terminal 21. Resin 26 is applied on the terminal supporting portion 11*b* to seal the solders 25.

In operation, when a driving signal of audio frequency is applied to the coil 24, the coil 24 generates an exciting force which interferes with the magnetism of the magnet 14. Accordingly, the diaphragm 23 is vibrated due to the attraction in the magnetic circuit 16 to generate sounds. When the frequency of the applied signal is low, no sound is generated from the diaphragm 23. Since the magnetic circuit 16 is resiliently supported in the frame 11, the relative position of the coil 24 to the magnetic circuit 16 changes, so that the magnetic circuit 16 is vibrated. The vibration is transmitted to the frame 11 causing a case in which the multifunction speaker 1 is housed to resonate. Accordingly, when the speaker 1 is provided in a small electronic instrument such as a game device and portable telephone, the user is able to feel the vibration at the fingertip or at other parts of the body with which the case is in contact.

In the present invention, the magnetic circuit 16 is enclosed by the metal protectors 17 and 18 so as not to be affected by the external electromagnetic waves. Furthermore, since the magnetic circuit 16 is electrically connected to the ground terminal 21, the magnetic circuit 16 is not affected by the waves. Thus the influence of the waves on other electronic devices in the instrument is eliminated.

Since the magnetic circuit 16 is supported by two springs 12 and 22, discomforting vibration noise is not generated even when the speaker is pressed to the ear with a shock.

In the present embodiment, one of the supporting springs may be omitted although the vibration of the magnetic circuit becomes less stable.

Figure 6:
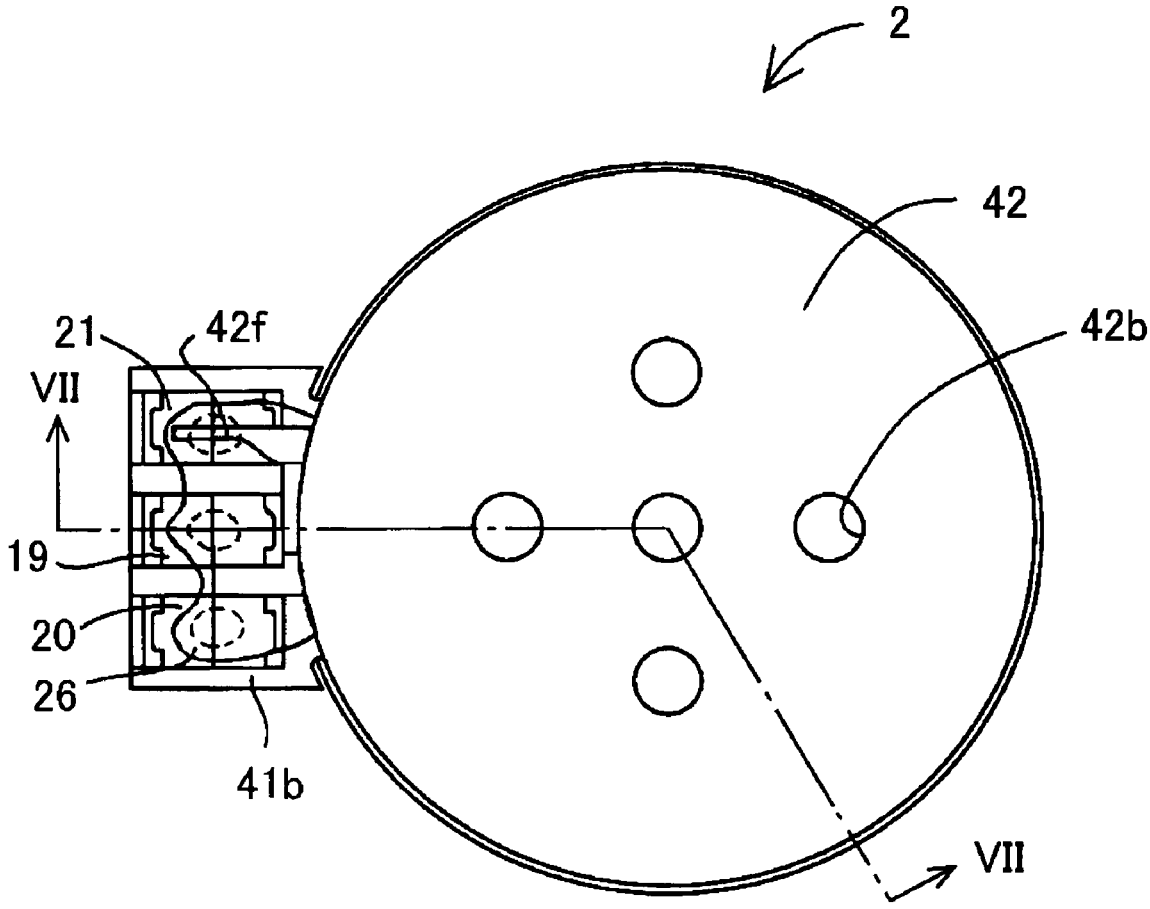
FIG. 6 is a plan view of a second embodiment of the multifunction speaker of the present invention.
Figure 7:
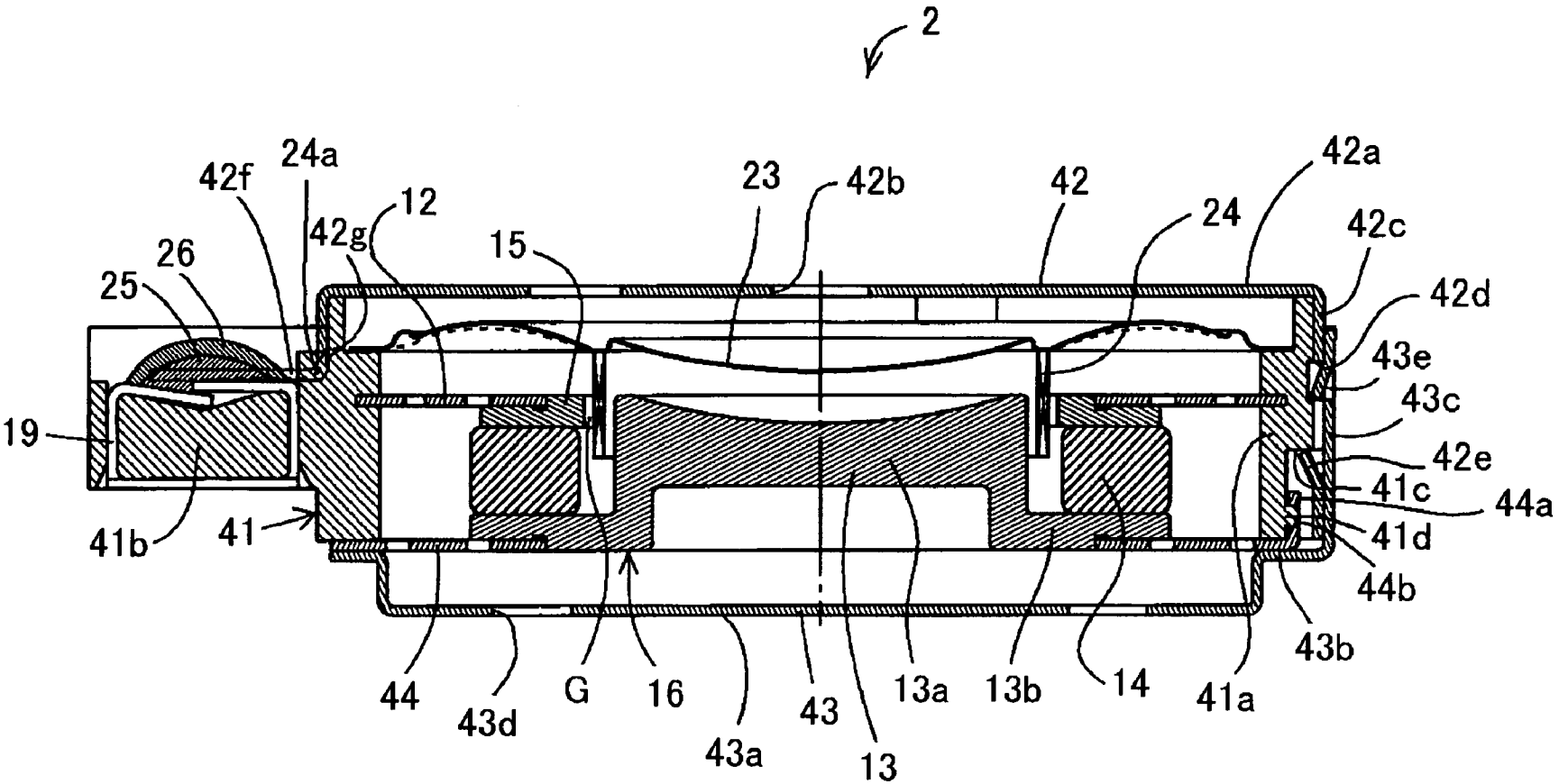
FIG. 7 is a sectional view taken along a line VII-VII of FIG. 6.
Figure 8:
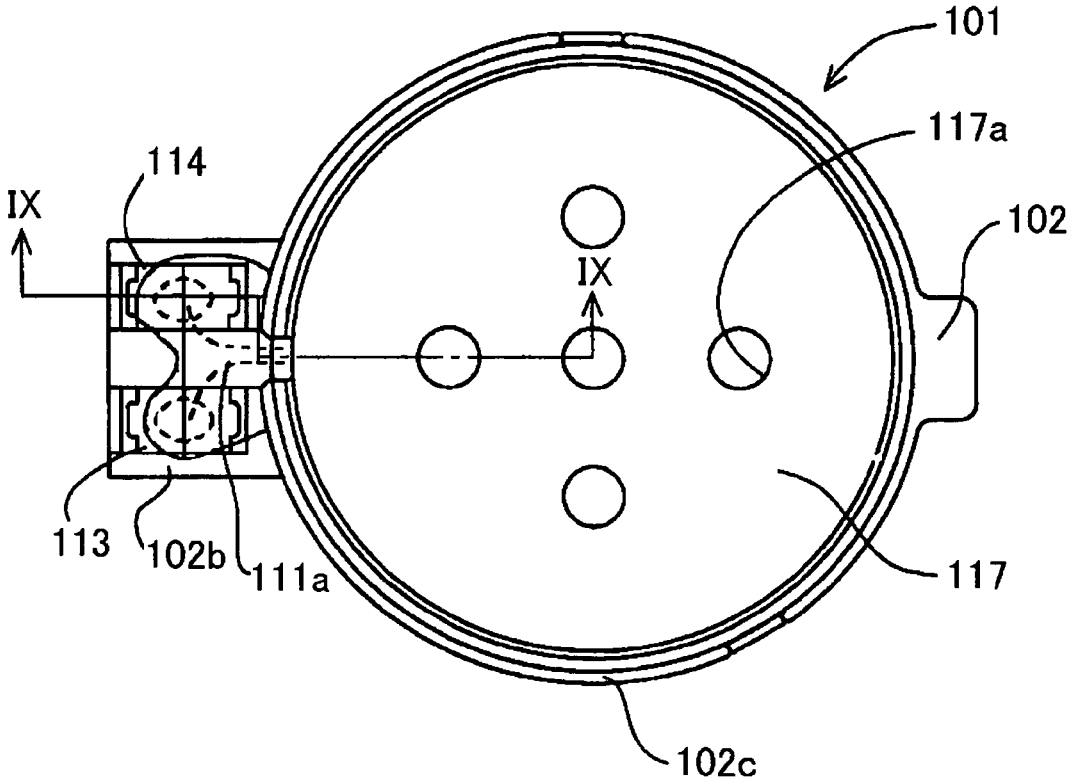
FIG. 8 PRIOR ART
FIG. 8 is a plan view of a conventional multifunction speaker.
Figure 9:
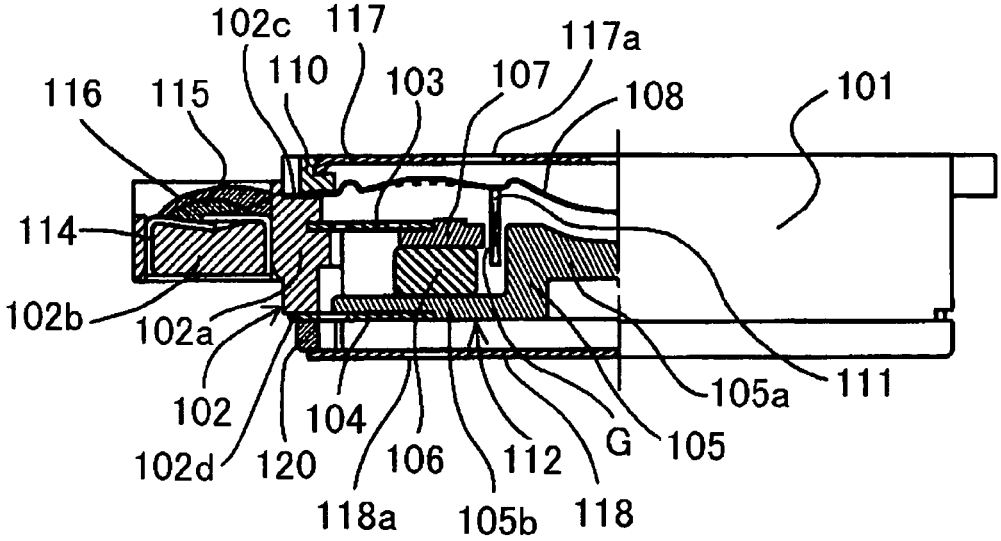
FIG. 9 PRIOR ART
FIG. 9 is a sectional view taken along a line IX-IX of FIG. 8.
Figure 10:
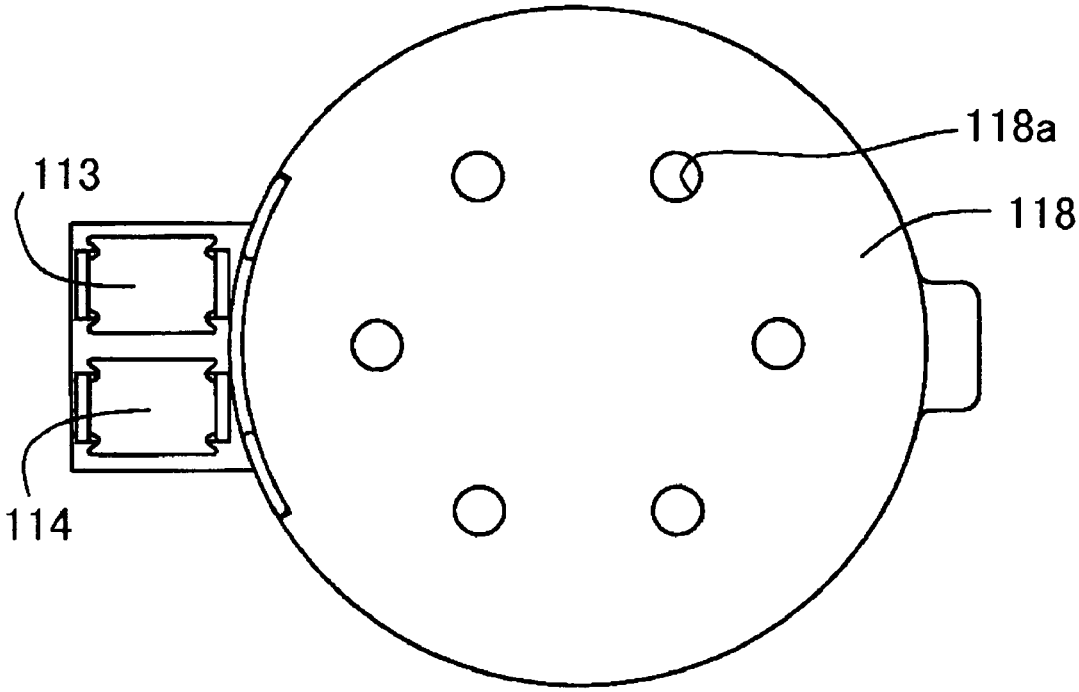
FIG. 10 PRIOR ART
FIG. 10 shows a bottom view of the speaker of FIG. 8.

FIGS. 6 and 7 show a second embodiment of the present invention. FIG. 6 is a plan view of a speaker according to the second embodiment of the present invention, and FIG. 7 is a sectional view of the speaker taken along a line VII-VII of FIG. 6.

Referring to FIGS. 6 and 7, a multifunction speaker 2 of the second embodiment comprises a substantially cylindrical molded frame 41, a cylindrical metal upper protector 42, and a cylindrical metal lower protector 43.

The frame 41 has a cylindrical portion 41*a* and a terminal supporting portion 41*b* outwardly extending from the cylindrical portion 41*a*. An annular recess 41*c* is formed on the lower periphery of the cylindrical portion 41*a*. The cylindrical portion 41*a* further has a plurality of projections 41*d* formed on the outer periphery thereof.

The lower protector 43 comprises a bottom plate 43*a* in which a plurality of vents 43*d* are formed, an annular step 43*b* surrounding the bottom plate 43*a*, and cylindrical-protruding portion 43*c* on the periphery of the step 43*b*. The height of the peripheral portion 43*c* is adapted to be larger than one half of the height of the frame 41. The lower protector 43 further has a plurality of tongues 43*e* formed by cutting out the cylindrical-protruding portion 43*c* and bending inward the cut out portions.

The cylindrical portion 41*a* of the frame 41 is mounted on the step 43*b* of the lower protector 43 interposing an annular lower supporting spring 44. The spring 44 has an upright portion 44*a* along the periphery thereof, so that the upright portion 44*a* engages with the recess 41*c* of the frame 41. The upright portion 44*a* has a plurality of holes 44*b* which engage with the projections 41*d* formed on the frame 41. The spring 44 may be welded on the step 43*b* of the protector 43.

On the spring 44, there is mounted the magnetic circuit 16 comprising the magnetic pole piece 13 having the center pole 13*a* and flange 13*b*, annular magnet 14 securely mounted on the flange 13*b*, and the annular top plate 15 securely mounted on the magnet 14. The top plate 15 is supported by the annular upper spring 12 which is partly embedded in the inner periphery of the cylindrical portion 41*a* of the frame 41.

The diaphragm 23 is mounted on an upper stepped portion of the frame 41, and the coil 24 is securely attached to the lower part of the diaphragm 23 and the coil 24 is inserted in a gap G formed between the inner periphery of the top plate 15 and the outer periphery of the center pole 13*a*.

The upper protector 42 has an upper plate 42*a* in which a plurality of sound emanating holes 42*b* are formed, and a cylindrical-protruding portion 42*c* surrounding the upper plate 42*a*. The height of the cylindrical-protruding portion 42*c* is adapted to be larger than one half of the height of the frame 41. The cylindrical-protruding portion 42*c* has a plurality of holes 42*d* for engaging with the tongue 43*e* of the lower protector 43.

The upper protector 42 is further provided with a plurality of tongues 42*e* which are formed by cutting out the cylindrical-protruding portion 42*c* and bending inward the cut out portions.

A part of the cylindrical-protruding portion 42*c* of the upper protector 42 is cut out to form a recess 42*g* through which the terminal supporting portion 41*b* of the frame 41 protrudes. A connecting lug 42*f* for connecting the upper protector 42 with the ground terminal 21 extends outward from a part of the cylindrical-protruding portion 42*c*. The positive terminal 19 and negative terminal 20, which are connected to the ends of the coil 24 by the solders 25, are provided in the terminal supporting portion 41*b* of the frame 41. The ground terminal 21 is connected to the connecting lug 42*f* by the solders 25. The resin 26 covers the solders 25.

When the upper protector 42 is mounted on the frame 41, each of the tongues 42*e* provided on the upper protector 42 engages with each of the recesses 41*c* of the cylindrical portion 41*a* of the frame 41, thereby securely mounting the upper protector 42 on the frame 41. At the same time, the tongues 43*e* of the lower protector 43 are inserted in the holes 42*d*. Thus the upper protector 42 is securely attached to the lower protector 43. Accordingly, the entire frame 41 except the terminal supporting portion 41*b* is covered by the upper and lower protectors 42 and 43 and each of the frame and the protectors is securely engaged with each other. In addition, the magnetic circuit 16 is electrically connected to the ground terminal 21 through the lower supporting spring 44, lower protector 43, upper protector 42, and the connecting lug 42*f*.

The other construction and operation of the second embodiment are the same as in the first embodiment. The upper spring 12 may be omitted in the present embodiment. The present embodiment may further be modified so that the positions of the upper protector 42 and the lower protector 43 are inverted.

The multifunction speaker of the present invention can be extensively applied in mobile transmission instruments such as portable telephone and PDA. Moreover, the multifunction speaker is not limited to the embodiments described above. For example, the magnetic circuit need not be the outer magnet type magnetic circuit described above, but may be an inner magnet type magnetic circuit wherein magnet and the top plate are securely mounted in a recess formed at the center of the pole piece. In addition, the frame may be comprised of two frames.

From the foregoing it will be understood that the present invention provides a multifunction speaker where a means for grounding speaker members is provided so that the electromagnetic waves and electric field waves do not affect the speaker.

While the invention has been described in conjunction with preferred specific embodiment thereof, it will be understood that this description is intended to illustrate and not limit the scope of the invention, which is defined by the following claims.

What is claimed is:

1. A multifunction speaker comprising:

a frame made of an insulation material and having a cylindrical portion and a terminal-supporting portion;

at least one supporting spring partly embedded in the frame;

a magnetic circuit comprising a pole piece having a center pole and a flange on which an annular magnet is mounted, and the magnetic circuit forming a magnetic gap and resiliently supported in the frame by the supporting spring;

a diaphragm secured to the frame at a peripheral edge of the diaphragm;

a coil secured to a lower part of the diaphragm and inserted in the magnetic gap;

an upper metal protector set on an upper portion of the frame;

a lower metal protector set on a lower portion of the frame;

the upper and lower protectors being fitted to each other at peripheral portions thereof so as to shield the entire frame except the terminal-supporting portion.

2. The multifunction speaker according to claim 1, wherein the supporting spring comprises a plurality of supporting springs, each of which is embedded in the frame.

3. The multifunction speaker according to claim 1, wherein each of the peripheral portions of the upper and lower protectors has a cylindrical-protruding portion, and one of the cylindrical-protruding portions has at least one opening and the other of the cylindrical-protruding portions has at least one inwardly bent portion which fits with the corresponding opening.

4. The multifunction speaker according to claim 1, wherein each of the peripheral portions of the upper and lower protectors has a cylindrical-protruding portion, and one of the cylindrical-protruding portions has a plurality of openings and the other of the cylindrical-protruding portions has a plurality of inwardly bent portions, each of which fits with the corresponding opening.

5. The multifunction speaker according to claim 1, wherein the upper and lower metal protectors have an overlapping portion at the peripheral portions thereof so as to be electrically connected.

6. The multifunction speaker according to claim 1, further comprising a pair of terminals and a ground terminal provided on the terminal-supporting portion, and wherein each of the terminals is connected to each corresponding end of the coil.

7. The multifunction speaker according to claim 1, wherein the terminal-supporting portion of the frame is outwardly projected from the cylindrical portion of the frame.

8. The multifunction speaker according to claim 1, wherein the magnetic circuit is electrically connected to one of the upper and lower protectors through the supporting spring.

9. The multifunction speaker according to claim 8, wherein the supporting spring has a frame-penetrating portion.

10. The multifunction speaker according to claim 9, the supporting spring has a bending portion to electrically contact one of the protectors.

11. The multifunction speaker according to claim 6, wherein the ground terminal is connected to one of the pair terminals.

* * * * *